US005141133A

United States Patent [19]

Ninomiya et al.

[11] Patent Number: 5,141,133

[45] Date of Patent: Aug. 25, 1992

[54] POURING PLUG OF A CONTAINER

[75] Inventors: Satoru Ninomiya, Osaka; Hideo Matsui, Tokyo, both of Japan

[73] Assignees: Marubeni Corporation, Osaka; Yamato Kakozai Co., Ltd., Tokyo, both of Japan

[21] Appl. No.: 664,621

[22] Filed: Mar. 4, 1991

[30] Foreign Application Priority Data

Mar. 6, 1990 [JP] Japan ..... 2-22416[U]

[51] Int. Cl.[5] ..... B67D 5/06

[52] U.S. Cl. ..... 222/83; 222/81; 222/541

[58] Field of Search ..... 222/81-83.5, 222/89, 91, 562, 541, 562, 563; 220/265, 267, 277, 278

[56] References Cited

U.S. PATENT DOCUMENTS

| | | | |
|---|---|---|---|
| 4,483,464 | 11/1984 | Nomura | 222/83 |
| 4,493,438 | 11/1985 | Rutter | 222/83 |
| 4,624,392 | 11/1986 | Malpas et al. | 222/83 |
| 5,020,690 | 6/1991 | Kishikawa et al. | 222/83 |

FOREIGN PATENT DOCUMENTS

| | | | |
|---|---|---|---|
| 58-37828 | 8/1983 | Japan . | |
| 62027 | 4/1985 | Japan | 222/83 |
| 63-86022 | 6/1988 | Japan . | |
| 64-35827 | 3/1989 | Japan . | |
| 64-35828 | 3/1989 | Japan . | |
| 1-66324 | 4/1989 | Japan . | |

*Primary Examiner*—Michael S. Huppert
*Assistant Examiner*—Kenneth DeRosa
*Attorney, Agent, or Firm*—Wenderoth, Lind & Ponack

[57] ABSTRACT

A pouring plug for a container having two members, namely a tubular body for mounting on a container wall and a lid mounted or threadedly mounted internally of the tubular body, a tubular blade is connected to an end of a mounting portion or threaded mounting portion of the lid by an easily rupturable connecting portion or portions, and a separating structure is provided between the tubular blade and the mounting portion or the threaded mounting portion. Rotation-stop elements for the tubular blade are provided between the outer wall of the tubular blade and the inner wall of the tubular body.

11 Claims, 6 Drawing Sheets

POURING PLUG OF A CONTAINER

BACKGROUND OF THE INVENTION

1. Field of the Invention

This invention relates to a pouring plug which can be mounted on a paper container of a rectangular flat-top type or a gable-top type.

2. Description of the Prior Art

As a conventional pouring plug mounted on a paper container of a flat-top type or a gable-top type, there is known a pouring plug which comprises a tubular body adapted to be mounted on a container wall, a cap fitted over the tubular body, and a thrusting member vertically movable mounted within the tubular body to rupture the container wall. Examples of such pouring plugs are shown in Japanese published Utility Model application No. 58-37828 of Aug. 26, 1983, and in Japanese Laid-Open Utility Model applications Nos. 63-86022, of June 4, 1988, 64-35827 of Mar. 3, 1989, 64-35828 of Mar. 3, 1989 and 1-66324 of Apr. 27, 1989.

The aforementioned thrusting member is designed so that for opening a container, first, the cap is removed from the tubular body, and subsequently the thrusting member is firmly pushed by a finger or the like toward the container wall to rupture the container wall (see Japanese Utility Model Published application No. 58-37828). This opening operation is not easy. To overcome this drawback, improvements have been made in the cap and the thrusting member such that threads meshed with each other (see Utility Model Laid-Open application No. 63-86022), two inclined surfaces opposed to each other (see Utility Model Laid-Open application No. 1-66324), or an inclined surface and a projection (see Utility Model Laid-Open applications Nos. 64-35827 and 64-35828) are provided so that when the cap is rotated, the thrusting member is moved up and down to open the container.

The pouring plugs for containers heretofore known each comprise three members, a tubular body, a cap and a thrusting member, which are molded of plastic (for example, polyethylene) and assembled. This causes a problem in that manufacturing and assembling are inefficient.

That is, in the manufacture, three kinds of molds are required, and three steps are required in the molding operation.

The assembling operation also requires two steps, one for incorporating the thrusting member internally of the tubular body, and the other for fitting the cap over the tubular body.

SUMMARY OF THE INVENTION

This invention has been accomplished in order to solve the above-described problems. An object of this invention is to provide a pouring plug for a container the manufacture and assembly of which can be made more efficient.

The pouring plug for a container according to this invention comprises two members, i.e. a tubular body which is adapted to be mounted on a container wall, and a lid for the tubular body, and a thrusting member is provided on the lid by means of a connecting portion which can easily be ruptured.

The pouring plug of a container according to this invention comprises a tubular body which is adapted to be mounted on a container wall and a lid mounted internally of an opening in the tubular body, characterized in that a tubular blade is provided on the end of the lid by means of a connecting portion connected to the lid and capable of being easily ruptured, a separating means is provided between the tubular blade and the connecting portion, and a rotation-stop means for the tubular body is provided between an outer wall of the tubular blade and an inner wall of said tubular body.

Mounting of the lid on the tubular body is carried out by engaging threads provided on an inner wall of an opening of the tubular body and on an outer wall of the lid mounting portion, or by providing continuous or discontinuous annular projections on the inner wall of an opening of the tubular body and on the outer wall of the lid mounting portion and engaging them with each other.

A further embodiment of a pouring plug for a container according to this invention comprises a tubular body which is adapted to be mounted on a container wall and a lid threadedly mounted internally of an opening of the tubular body, characterized in that a tubular blade is provided on the end of the lid by means of a connecting portion capable of being easily ruptured, and a separating means is provided between the tubular blade and the lid threaded-mounting portion.

The separating means in these pouring plugs can have a construction in which an inclined surface provided on the tubular blade is opposed to another inclined surface provided on the mating portion of the lid mounting portion or threaded-mounting portion, or a construction in which an inclined surface provided on one part is opposed to a projection provided on the other part.

The rotation-stop means for the tubular blade is composed of projections provided on the outer wall of the tubular blade and a mating portion of the inner wall of the tubular body, a projection provided on one and a recess provided on the other, or a rough surface formed on the mating portion of both members, which are engaged with each other to prevent the tubular blade from rotating.

The thus constructed pouring plug for a container according to this invention is mounted when it is to be used on a portion of a container wall in which a opening is to be formed. Therefore, it is desirable that the distance between the lid mounting portion or threaded mounting portion and the tubular blade through the connecting portion capable of being easily ruptured is less than the height of the tubular body. It is further desirable that the tubular blade be smaller in diameter than the portion in which the opening in the container wall is to be formed. However, this invention need not always be limited to these configurations.

Since the pouring plug of the container according to this invention comprises two members, i.e. a tubular body and a lid provided with a tubular blade and connected by a connecting portion capable of being easily ruptured, only two kinds of molds will suffice for molding and only molding operations need be used to manufacture the plug. Further, in assembly, the tubular blade is merely incorporated into the lid and one step will suffice for the assembly operation.

BRIEF DESCRIPTION OF THE DRAWINGS

These and other objects, features and advantages of the present invention will be more clearly appreciated from the remainder of the specification in which some preferred embodiments will be described in further detail with reference to the accompanying drawings, in which.

DESCRIPTION OF THE PREFERRED EMBODIMENTS

Embodiments of this invention will be described hereinafter with reference to the drawings.

Figure 1:
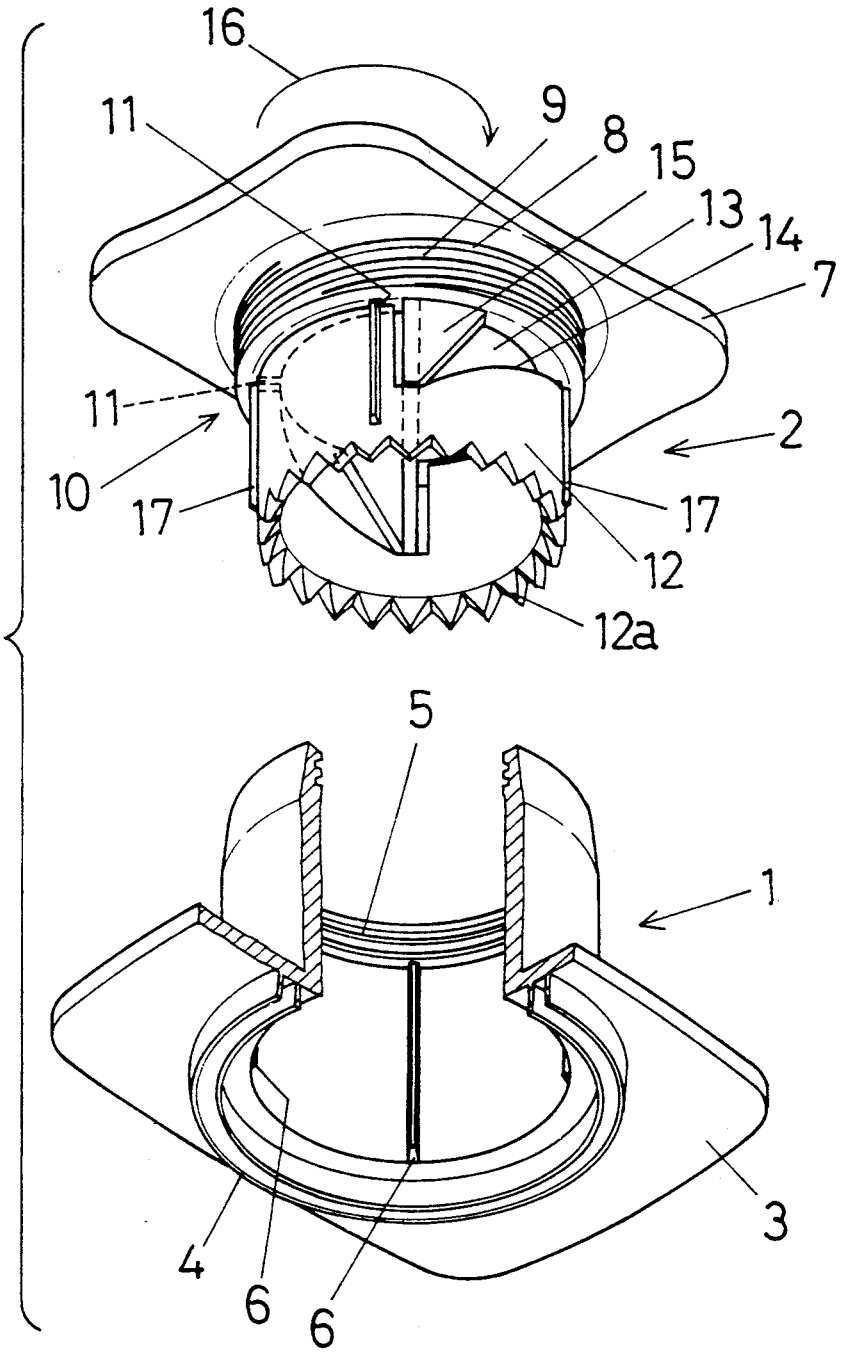
FIG. 1 is a partly cut-away exploded perspective view of a first embodiment of this invention.
Figure 2:
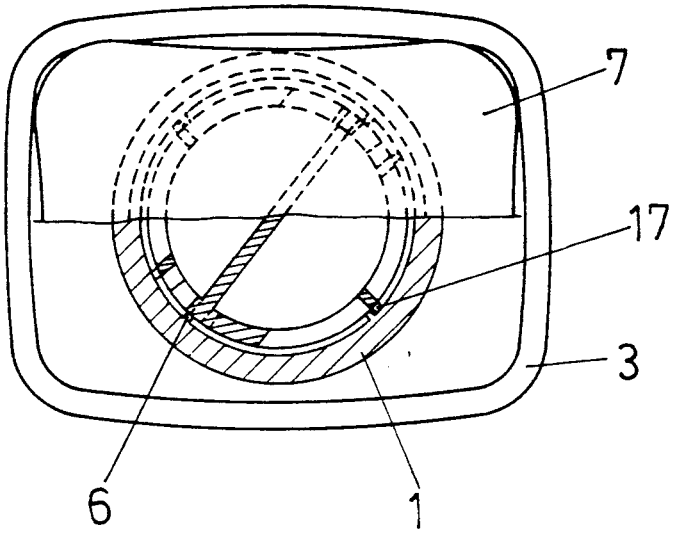
FIG. 2 is a partly cut-away plan view thereof.
Figure 3:
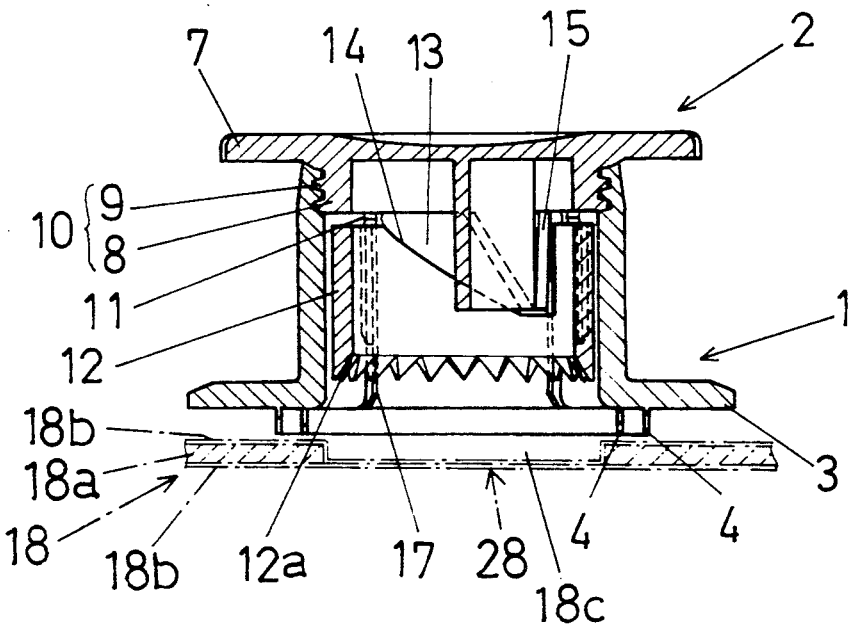
FIG. 3 is a longitudinal sectional view thereof.

FIGS. 1-3 show a pouring plug for a container comprising a tubular body 1 which is adapted to be mounted on a container wall and lid 2 threadedly mounted internally of an opening of the tubular body.

The tubular body 1 is provided at the lower end with an annular collar 3, and an annular projection 4 is provided on the lower surface of the annular collar 3. The tubular body 1 is provided at the upper portion of the inner wall surface with threads 5, and elongated projections 6 extend lengthwise on the inner wall from the lower side of the threads 5 to the annular collar 3.

The lid 2 comprises a top plate 7 and a tubular portion 8 provided on the lower surface of the top plate 7, and threads 9 having the same pitch as the threads 5 are provided on the outer wall of the tubular portion 8 to constitute a threaded mounting portion 10 for engagement with the tubular body 1. On the lower end of the threaded mounting portion 10 is provided a tubular blade 12 having at the lower end edge a saw-tooth blade 12*a*. The tubular blade 12 is connected to the mounting portion 10 by means of four connecting portions 11 capable of being easily ruptured and positioned symmetrically around the tubular blade.

The tubular blade 12 is provided with cuts 13 in the upper part thereof at diametrically opposite positions. The edge of the cuts of the tubular blade opposed to the tubular portion 8 of the lid 2 is an inclined surface 14 and a projection 15 opposed to the inclined surface 14 extends downwardly from the tubular portion 8, the inclined surface and the projection 15 constituting a separating means in the form of a cam surface and a cam. That is, when the lid 2 is rotated in the direction indicated by arrow 16 with respect to the tubular blade 12, a force in a direction for moving the tubular blade 12 away from the lid 2 is produced on the tubular blade.

Further, lengthwise extending projections 17 are provided at diametrically opposite positions on the outer wall of the tubular blade 12.

Assembly of the tubular body 1 and the lid 2 is carried out by forcibly pushing the lid 2 into the tubular body 1. By this pushing, the threads 5 of the tubular body 1 and the threads 9 provided on the tubular portion 8 of the lid 2 are engaged with each other, and the projection 6 provided on the inner wall of the tubular body 1 and the projections 17 provided externally of the tubular blade 12 are engaged with each other.

In this embodiment, the distance from the threaded mounting portion 10 to the saw-tooth blade 12*a* of the tubular blade 12 including the easily returnable portions 11 is less than the height of the tubular body 1 so that during assembly the saw-tooth blade 12*a* of the tubular blade 12 is not caused to project from the lower opening of the tubular body 1.

The pouring plug for a container according to the above-described embodiment is mounted by placing the annular projection 4 of the tubular body 1 against a container wall 18 shown by dot-dash lines in FIG. 3. The container wall 18 is constructed such that a synthetic resin film 18*b* is laminated to both sides of a cardboard wall 18*a*. The part of the wall on which the pouring plug is mounted has a portion 28 where the opening is to be formed which is formed from only the synthetic resin film 18*b* which fills a through hole 18*c* in cardboard wall 18*a* formed in advance. Accordingly, when the diameter of the tubular blade 12 is made smaller than that of the portion 28 in which the opening is to be formed. an allowance for variations in the mounting accuracy of the tubular body 1 on the container wall 18 is advantageously obtained.

Figure 4:
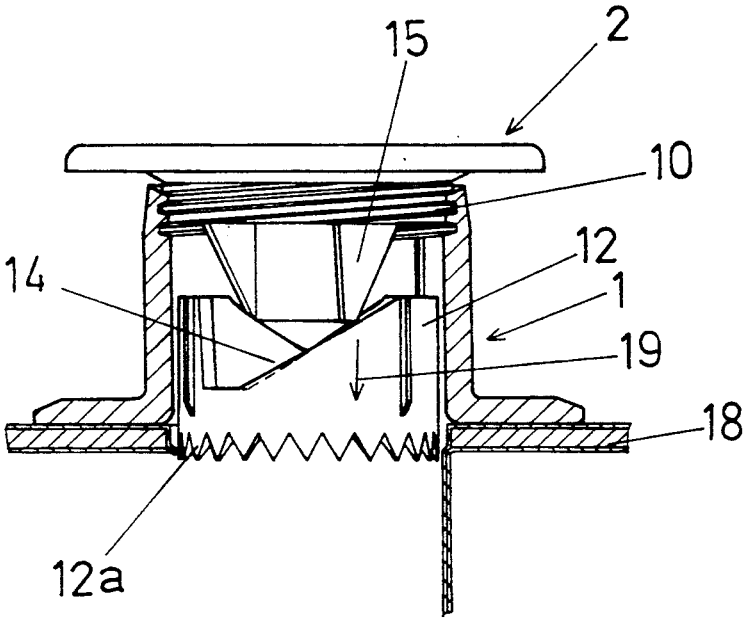
FIG. 4 is a longitudinal sectional view thereof when a container has been opened.

In opening the container, when the lid 2 is rotated in an unscrewing direction as indicated by the arrow 16, the tubular blade 12 provided on the threaded mounting portion 10 is prevented from being rotated by the engagement between the projections 17 and the projections 6. The projections 15 therefore move circumferentially relative to the tubular blade 12, rupturing the portions 11 and driving the tubular blade 12 downwardly in the tubular body 1 as shown in FIG. 4.

Therefore, the tubular blade 12 is separated from the lid 2 and moved in a direction as indicated by an arrow 19 by the action of the projections 15 on the inclined surfaces 14. As a result, the container wall 18 is ruptured and opened by the saw-tooth blade 12*a* of the tubular blade 12.

The aforesaid rupture and opening is completed by rotating the lid 2 by 90° (the inclined surface extends in the range of 90° ). When the lid 2 is rotated to completely separate the threaded engagement of the threaded mounting portion 10, the contents of the container can be poured through the tubular body 1. The lid 2 can again be threadedly mounted on the tubular body 1 whereby the opened tubular body 1 can be closed.

Figure 5:
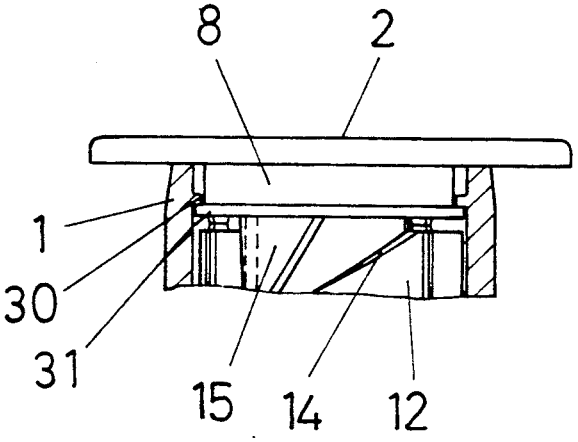
FIG. 5 is a partial longitudinal sectional view of a second embodiment of this invention.

The engagement between the tubular portion 8 of the lid 2 and the inner portion of the opening of the tubular body 1 is not limited by the threaded mounting portion 10 in which the threads 9 are provided on the tubular portion 8, but a configuration may be employed in which, as shown in FIG. 5, an annular projection 30 is provided internally of an opening of the tubular body 1 and an annular projection 31 is also provided on the tubular portion 8 of the lid 2 so that the two projections 30 and 31 are engaged with each other.

In this case, the tubular blade 12 can be separated simply by rotation of the lid 2, and accordingly, after the container wall has been ruptured and opened, the lid 2 is forcedly removed outwardly from or forced into the tubular body 1, whereby the tubular body 1 can be opened and closed.

The annular projections 30 and 31 can be continuous or discontinuous through a predetermined angle to facilitate removal of the lid 2.

Furthermore, the top plate 7 of the lid 2 can have the shape of a planar circle or a polygon to eliminate the directivity (in a rotational direction) with respect to the tubular body 1. In this case, the projections 6 provided on the inner wall of the tubular body 1 are provided in a predetermined spaced relation so that even when the lid 2 is fitted in any direction, the projection 17 on the tubular blade 12 can be engaged.

Figure 6:
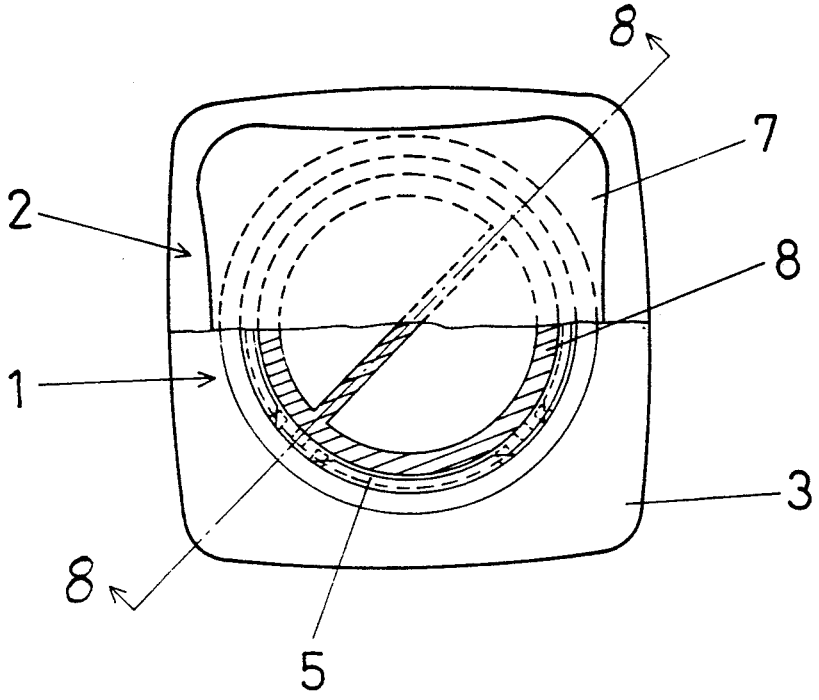
FIG. 6 is a partly cut-away plan view of a third embodiment of this invention.

Next, the embodiment shown in FIGS. 6–8 will be described. Parts similar to the parts in the above-described embodiment are indicated by the same reference numerals, and a description thereof is omitted.

The threads 5 provided internally of the opening of the tubular body 1 are discontinued every 90° , and guide projections 20 are longitudinally provided below the discontinuous portion of the threads 5, and a longitudinal groove 21 is formed between the guide projections 20. The lid 2 is designed so that the tubular blade 12 is connected to the tubular portion 8 by means of the easily rupturable portions 11, and the lower end of the tubular portion 8 and the upper end of the tubular blade 12 constitute a separating means in which inclined surfaces 22 and 23 with slopes being opposite every 90° in the circumferential direction are opposed to each other.

Assembly of the tubular body 1 and the lid 2 in this embodiment is carried out by registering positions of the projections 17 and the longitudinal groove 21, pushing the lid 2 into the tubular body 1 and engaging the threads 5 and threads 9.

Figure 9:
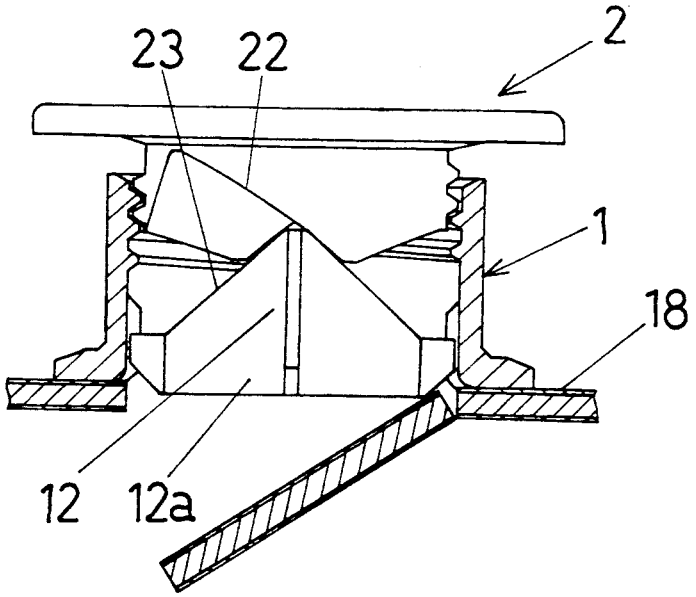
FIG. 9 is a longitudinal sectional view thereof when a container is opened.

FIG. 9 shows the pouring plug mounted on the container wall 18 and with the container in the opened state. The container is opened by rotating the lid 2 similarly to the previous embodiment. After the easily rupturable portion 11 has been ruptured, the tubular blade 12 is pushed down by the separating means comprising the inclined surfaces 22 of the tubular portion 8 of the lid 2 and the inclined surfaces 23 of the tubular blade 12 to rupture and open the container wall 18.

Figure 10:
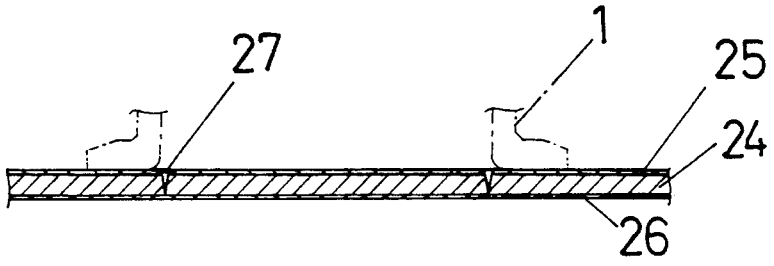
FIG. 10 is a sectional view of a container wall on which a tubular body according to this invention is to be mounted.

The container wall 18 ruptured and opened by the blade **12*a* of the tubular blade 12 has synthetic resin films 25 and 26 laminated to opposite sides of a paper layer 24 as shown in FIG. 10, and an annular score 27 is provided in advance to define a portion expected to form an opening. The diameter of the tubular blade 12 is made smaller than that of the annular score 27, whereby an allowance for the accuracy of the mounting position of the tubular body 1 on the container wall 18 can be obtained. The saw-tooth blade 12*a* of the tubular blade 12 can have a tapered configuration in which a cylindrical end has an extreme end formed into a thin wall, a cylindrical end instead of a tapered configuration, or a saw-tooth blade as in the embodiment shown in FIGS. 1–5**.

In these embodiments, the distance from the threaded mounting portion 10 of the lid 2 and the lower end of the tubular blade 12 including the easily rupturable portions 11 is less than the height of the tubular body 1. This is effective for, when the lid 2 is assembled on the tubular body 1, preventing the saw-tooth blade **12*a* of the tubular blade 12 from projecting from the lower end of the tubular body 1**.

Figure 7:
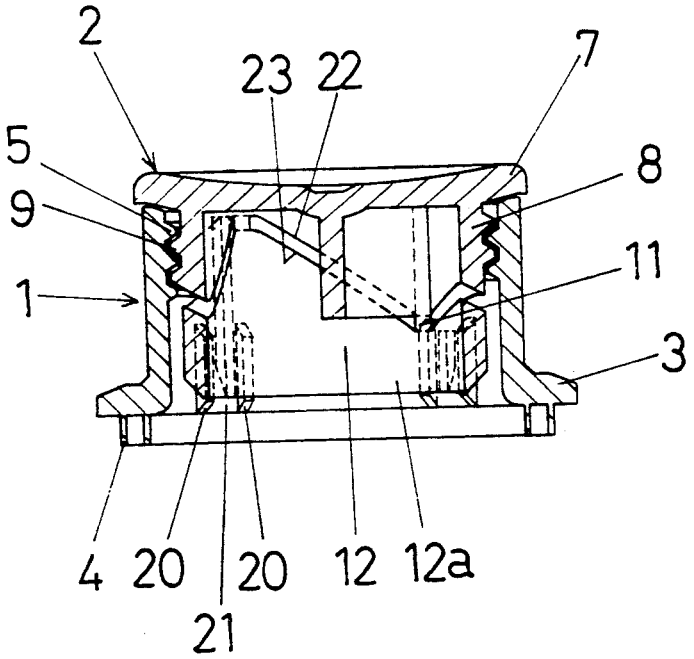
FIG. 7 is a longitudinal sectional view thereof.
Figure 8:
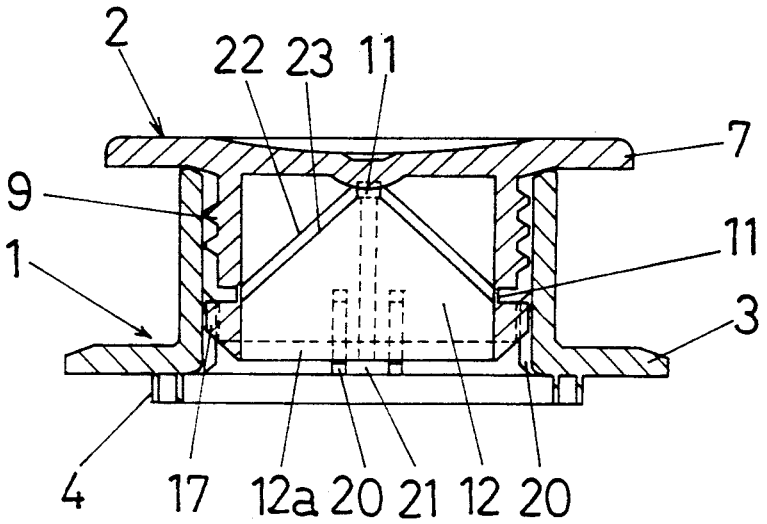
FIG. 8 is a longitudinal sectional view taken along a line 8—8 in FIG. 6.

However, alternatively, the length between the mounting portion and the lower end of the tubular blade 12 including the easily rupturable portions 11 can be greater than the height of the tubular body 1, and when the lid 2 is rotated while threadedly engaged with the tubular body 1, the action of the separating means is obtained (for example, see the embodiments shown in FIGS. 7–9). In this case, by the operation in which the lid 2 is threadedly engaged with the tubular body 1, the container wall 18 is ruptured and opened, and the opening of the tubular body 1 can be blocked by the top plate 7 of the lid 2 to prevent an overflow of the liquid contained in the container.

Figure 11:
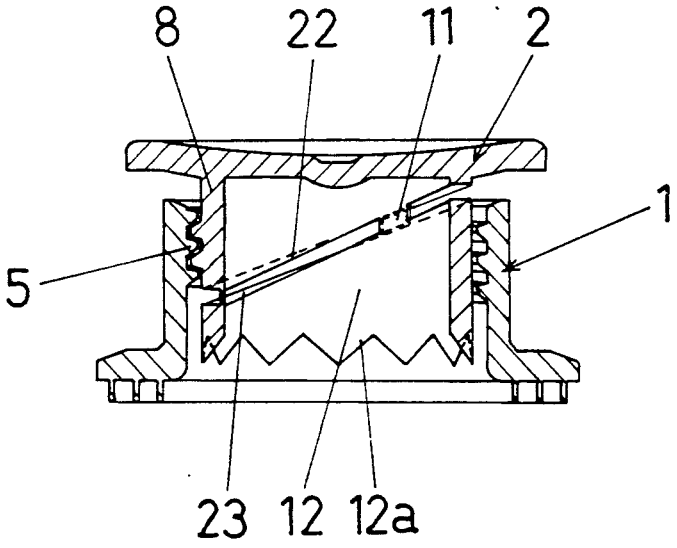
FIG. 11 is a longitudinal sectional view of a fourth embodiment of this invention.

Next, in the embodiment shown in FIG. 11, the tubular blade 12 is provided at the lower end edge thereof with the saw-tooth blade **12*a*, and the rotation-stop means such as the projections, longitudinal groove and the like between the outer wall of the tubular blade 12 and the inner wall of the tubular body 1 can be eliminated so that the tubular blade 12 is rotatable. The distance between the tubular portion 8 of the lid 2 and the lower end of the tubular blade 12 including the easily rupturable portions 11 is greater than the height of the tubular body 1**.

The opening operation in this embodiment is carried out by rotating the tubular body 1 in a direction for bringing the lid 2 into threaded engagement with the tubular body 1. This rotation first causes the tubular blade 12 to be moved down while rotating along with the lid 2, and the tubular blade 12 moves toward the container wall 18. When the saw-tooth blade **12*a* on the tubular blade 12 bites into the container wall 18, the rotation thereof is prevented, and as a result, the easily rupturable portions 11 integral with the lid 2 and the tubular blade 12 are ruptured After the easily rupturable portions 11 have been ruptured, the separating means comprising the inclined surfaces 22 and 23, whereby the tubular blade 12 is firmly pressed down toward the container wall 18 to rupture and open the container wall 18**.

As described above, according to the present invention, the container wall can be ruptured and opened by the rotation of the lid. The pouring plug comprises a tubular body which is to be mounted on the container wall and a lid integrally joined with a tubular blade by means of a connecting portion capable of being easily ruptured, which therefore achieves the result that efficiency of the manufacture and assembly is improved.

In the case where the distance from the mounting portion or threaded mounting portion of the lid to the lower end of the tubular blade including the easily rupturable connecting portions is less than the height of the tubular body, during assembly of the tubular body and the lid, the lower end edge of the tubular blade does not project from the tubular body and therefore premature rupturing of the container wall is avoided. Conversely, when the aforesaid distance is greater than the height of the tubular body, when the lid is threadedly engaged with the tubular body, the container wall is ruptured. It is possible to provide a pouring plug which can prevent overflow of liquid contained in the container at the time of rupture.

Moreover, when the tubular blade is made smaller in diameter than the portion in which an opening is to be formed on the container wall, an allowance for accuracy in the mounting position of the tubular body on the container wall is provided, which is advantageous in the mounting operation.

Although the present invention has been described with particular reference to the several preferred embodiments thereof, it should be understood that various changes and modifications may be made without departing from the scope and spirit of the invention.

We claim:

1. A two piece pouring plug for a container, comprising:

a hollow tubular body having a lower end for mounting on a container wall; and a lid member removably mounted on an upper end of said tubular body and having a lid mounted over the open upper end of said tubular body and said lid having a mounting portion on the under side thereof and a tubular blade connected to a lower end of said mounting portion of said lid by at least one easily rupturable connecting portion integrally formed with said tubular blade and said mounting portion, said lid member having a separating means between said tubular blade and said mounting portion, and a rotation stop means for the tubular blade on each o the outer wall of said tubular blade and the inner wall of said tubular body and engageable for stopping relative rotational movement of said tubular blade and said tubular body.

2. A two piece pouring plug for a container, comprising:

a hollow tubular body having a lower end for mounting on a container wall; and a lid member removably threadedly mounted on an upper end of said tubular body and having a lid mounted over the open upper end of said tubular body and said lid having a threaded mounting portion on the under side thereof and a tubular blade connected to a lower end of said mounting portion of said lid by at least one easily rupturable connecting portion integrally formed with said tubular blade and said mounting portion, said lid member having a separating means between said tubular blade and said mounting portion, the distance from said mounting portion of said lid to a lower end of said tubular blade being greater than the distance from the upper end to the lower end of said tubular body.

3. A pouring plug as claimed in claim 1 or 2 wherein said separating means has inclined surfaces on said tubular blade and said mounting portion, said inclined surfaces being opposed to each other for causing said tubular blade to be moved toward the lower end of said tubular body when said mounting portion is rotated relative to said tubular blade.

4. A pouring plug as claimed in claim 1 or 2 wherein said separating means comprises an inclined surface on one of said tubular blade and said mounting portion and a projecting on the other of said tubular blade and said mounting portion, said inclined surface and projection being engaged with each other for causing said tubular blade to be moved toward the lower end of said tubular body when said mounting portion is rotated relative to said tubular blade.

5. A pouring plug as claimed in claim 1 in which said rotation stop means is a projection one each of said tubular body and said tubular blade.

6. A pouring plug as claimed in claim 1 in which said rotation stop means is a projection on one of said tubular body and said tubular blade and a recess in the other of said tubular body and said tubular blade.

7. A pouring lug as claimed in claim 1 in which said rotation stop means is a rough surface one each of said tubular body and said tubular blade.

8. A pouring lug as claimed in claim 1 in which said lid member and said tubular body each have thread means thereon for being engaged to mount said lid member on said tubular body.

9. A pouring plug as claimed in claim 1 in which said lid member and said tubular body each have continuous or discontinuous annular projections thereon for being engaged to mount said lid member on said tubular body.

10. A pouring plug as claimed in claim 1 in which the distance from said mounting portion of the lid to a lower end of said tubular blade which includes said easily rupturable connecting portion is less than the distance form the upper end to the lower end of said tubular body.

11. A pouring plug according to claim 1 or 2 in which said tubular blade is smaller in diameter than portion of the container wall in which an opening is to be formed by said tubular blade.

* * * * *